US007050357B1

(12) United States Patent
Garcia

(10) Patent No.: US 7,050,357 B1
(45) Date of Patent: May 23, 2006

(54) GLOBAL TIME INDICATOR

(76) Inventor: Eddie M. Garcia, 5546 Oak Glen Rd., Edina, MN (US) 55439

( * ) Notice: Subject to any disclaimer, the term of this patent is extended or adjusted under 35 U.S.C. 154(b) by 0 days.

(21) Appl. No.: 10/898,803

(22) Filed: Jul. 26, 2004

Related U.S. Application Data

(63) Continuation-in-part of application No. 10/147,939, filed on May 17, 2002, now Pat. No. 6,788,622.

(60) Provisional application No. 60/291,786, filed on May 17, 2001.

(51) Int. Cl.
*G04B 19/22* (2006.01)

(52) U.S. Cl. ..... 368/21; 368/22; 368/27

(58) Field of Classification Search ..... 368/21–27, 368/77, 233–235; 116/308
See application file for complete search history.

(56) References Cited

U.S. PATENT DOCUMENTS 1,344,913 A * 6/1920 Long ..... 368/27
1,607,560 A 11/1926 Pennino
D141,710 S 6/1945 Guttmann
2,463,758 A 3/1949 Freel
D181,407 S 11/1957 Chamberlin
3,115,002 A * 12/1963 Beresford ..... 368/27
3,190,257 A 6/1965 Blythe, Jr.
3,858,334 A 1/1975 Eisenhauer
3,936,957 A 2/1976 Nordbye
4,032,754 A 6/1977 Ageton
D289,905 S 5/1987 Goldring
4,847,819 A 7/1989 Hong
4,974,217 A * 11/1990 Inoue ..... 368/108
5,054,008 A 10/1991 Darling
6,006,986 A 12/1999 Whalen

* cited by examiner

*Primary Examiner*—Kamand Cuneo
*Assistant Examiner*—Thanh S. Phan

(57) ABSTRACT

A global time indicating calculator has a clock member with a rotating dial for calculating global standard time and advanced time in various international time zones. Indicia printed on the face of the dial and corresponding boxes on oppositely opposed faces of the calculator can be easily referenced to determine time of day at selected locations throughout the world. The faces have recesses therein to interchangeably accommodate the clock member whereby the calculator can be modified to calculate the time of day during either standard time or advanced time periods.

14 Claims, 11 Drawing Sheets

GLOBAL TIME INDICATOR

CROSS REFERENCE TO RELATED APPLICATION

This application is a continuation-in-part of U.S. application Ser. No. 10/147,939 filed May 17, 2002 now U.S. Pat. No. 6,788,622. U.S. application Ser. No. 10/147,939 claims the benefit of U.S. Provisional Application Serial No. 60/291,786 filed May 17, 2001.

FIELD OF THE INVENTION

The invention is in the art of timing devices, particularly time keeping devices which indicate international or global time.

BACKGROUND OF THE INVENTION

Worldwide there are twenty-four different geographical regions within which a different standard time is used. In the United States there are four different time zones; Pacific, Mountain, Central and Eastern time zones. Often there is a need to determine time of day or night at various locations or geographical regions when traveling, or when making interregional telephone calls, e-mails, facsimiles and the like. In today's business environment, and even during daily personal activities, people are inundated with news and information from all over the world. To understand and process this information correctly it is often helpful to be aware of the local time at the information source location. Also, certain localities have advanced time or daylight savings time, which is a time usually one hour ahead of standard time at various times of year to maximize daylight hours. The global time indicator of the invention avoids the need for repeated calculation of time throughout the world.

SUMMARY OF THE INVENTION

The indicator of the invention is used to indicate international time by dialing present local time and reading indicia on the face of the indicator to determine time at a different locale. Repeated time determinations are fast and accurate.

The indicator is a hand held or bag tag member having a front wall and a back wall accommodating a dial used to indicate time. The dial has an outer annular ring marked with numerical indicia and scale indicia along its circumference for measuring time at selected increments. When the dial is manually rotated to indicate present local time, times at various other geographical regions are displayed.

A modification of the indicator is a wall mounted international time indicator having a removably mounted clock member rotating a dial for indicating time of day. The dial has numerical and scale indicia for measuring time. The indicia on the dial are compared to printed matter and line indicia on the front wall or back wall of the indicator to determine time in other parts of the globe at one glance. During a time change between standard and advanced time periods the clock member is associated with the corresponding front or back wall of the indicator to be consistent with the time change.

A second modification of the indicator is a desk supported time indicator having a time dial rotated by a clock member. A base is used to support the indicator on a horizontal surface such as a desktop.

DESCRIPTION OF PREFERRED EMBODIMENTS

Figure 1:
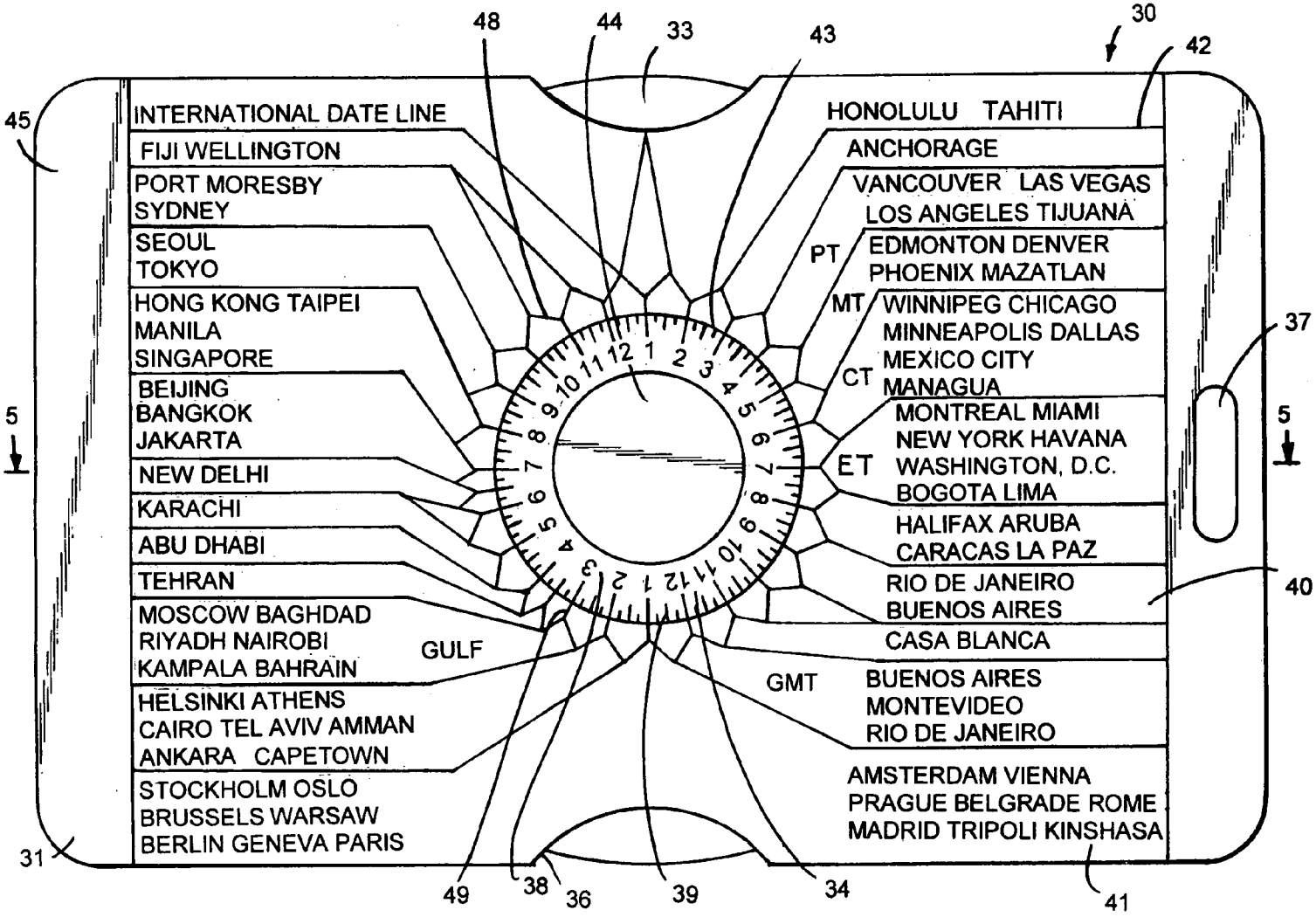
FIG. 1 is a front elevational view of the global time indicator of the invention.

Referring to FIGS. 1 to 5, there is shown a time indicator 30 of the invention. Indicator 30 is used to indicate global standard time and advanced time at various worldwide locations. Indicator 30 is a three-piece member having a rectangular front wall 31 and rectangular back wall 32 accommodating a generally circular dial 33. Walls 31 and 32 and dial 33 are constructed of semi-rigid material, such plastic or cardboard joined with an adhesive 46. Indicator 30 is preferably a generally flat, rectangular shaped, wallet-sized three-piece laminated plastic or layered structure. Front wall 31 and back wall 32 can be lined with magnetic material for attachment to magnetic attracting surfaces such as refrigerator and metal file cabinet surfaces.

As shown in FIG. 1, dial 33 has a generally circular outwardly projecting center hub 34. Hub 34 has an outer generally flat front face 44 having numerical indicia 38 and scale indicia 39 printed on the outer periphery thereof to indicate time of day. Numerical indicia 38 and scale indicia 39 indicate two equal 12-hour periods in 15 minute increments. It may be desirable to have a shaded portion to differentiate the afternoon and evening 12-hour period from the morning 12-hour period numerical indicia indicating one 24-hour time period. Front wall 31 has a centrally located generally circular opening 43 for accommodating hub 34 of dial 33. The outer front surface 44 of hub 34 is generally flush with the outer surface of front wall 31. Hub 34 has an outer annular surface bearing against an annular surface surrounding opening 43 to hold dial 33 in assembled relation with front and back walls 31 and 32. The center of outer surface 44 is available for advertising or a company logo to be imprinted thereon.

Back wall 32 has line indicia 54 and printed material 56 similar to numerical and scale indicia 38 and 39 and printed matter 41 located on front wall 31 to reference advanced time or day light savings time. Back wall 32 has a center opening 53 to expose the outer back surface 58 of hub 34 having numerical and scale indicia 51 and 52 which is imprinted thereon for calculating international time zones during advanced or daylight savings time periods. Indicator 30 can have other dimensions and be made of other types of semi-rigid materials.

Figure 2:
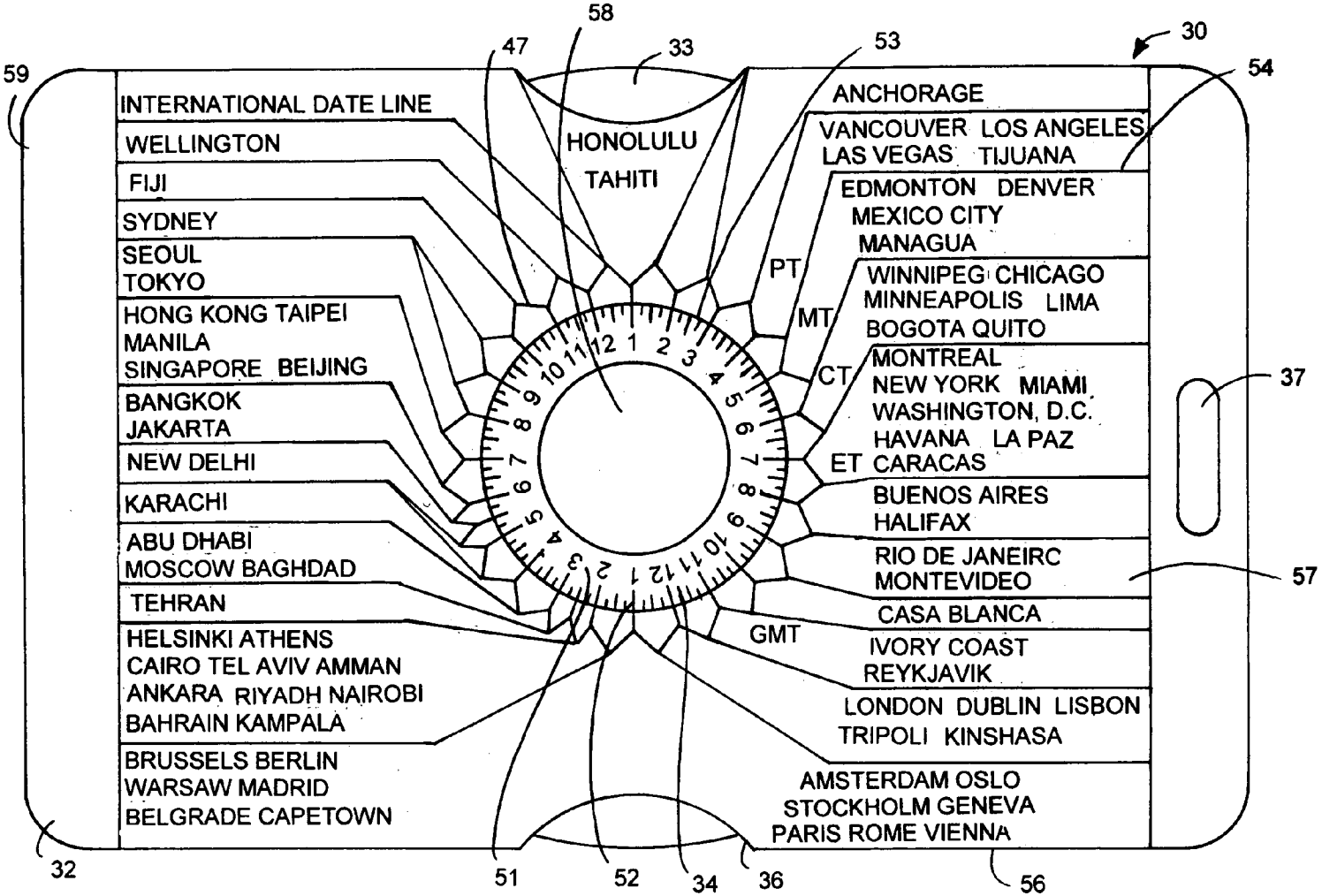
FIG. 2 is a rear plan view thereof.
Figure 4:
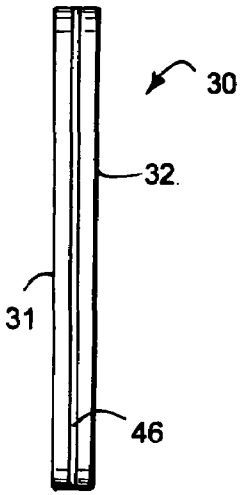
FIG. 4 is a right side view thereof.
Figure 3:
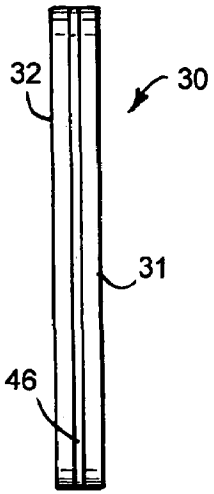
FIG. 3 is a left side view thereof.
Figure 5:
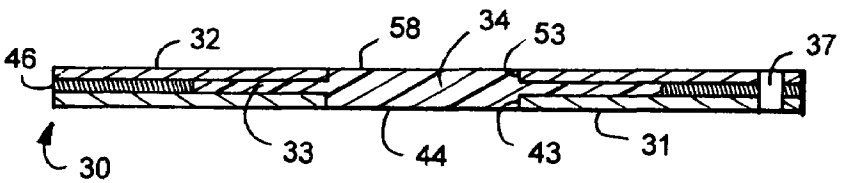
FIG. 5 is a sectional view taken along line 5—5 of FIG. 1.

As seen in FIGS. 1 and 2, the opposite side edges of walls 31 and 32 have recesses or grooves 36 to expose the outer annular edge of dial 33. Dial 33 is manually rotated to indicate present local time of the user's location whereby the standard time of day or night of other international locations can be quickly and conveniently determined at one glance. Front wall 31 has a flat outer surface having line markings or indicia 42 forming a plurality of generally rectangular shaped vertically disposed sections or boxes 40 located between longitudinal end boxes 45. Each box 40 represents a geographical region within which the same standard time is used. Horizontally disposed printed matter 41 located in boxes 40 identifies localities, such as major metropolitan areas, capital cities, and ports within each geographical region, and time zones, such as Pacific, Mountain, Central, Eastern and Greenwich time zones, whereby quick reference may be made to determine the relative standard time of the various localities and time zones. Y-shaped angle bracket members 48 closing the inner ends of the boxes 40 have linear ends or stems 49 are located adjacent time indicia 38 and 39 on hub 34 to facilitate alignment of indicia 38 and 39 with the corresponding box 40 in the calculation of global standard time. Indicator 30 has a slot 37 for accommodating a chain or strap for attachment to luggage or a briefcase.

Referring to FIG. 2, back wall 32 has a centrally located opening 53 for accommodating the back of hub 34 projecting outwardly from the back side of dial 33. Opening 53 is aligned with the opening 43 in front wall 31. Hub 34 has a flat outer back surface 58 generally flush with the outer surface of back wall 32. Hub 34 has an outer annular surface bearing against an annular surface surrounding opening 53 to hold dial 33 in assembled relation with front and back walls 31 and 32. Outer rear face 58 of hub 34 has numerical indicia 51 and scale indicia 52 printed on the periphery thereof to designate time periods similar to numerical and scale indicia 38 and 39 printed on the outer front face 44 of hub 34.

The outer surface of back wall 32 has line indicia 54 forming vertically disposed rectangular boxes 57 located between longitudinal end boxes 59. Each box 57 represents a geographical region within which the same time is used during advanced time periods. Printed matter 56 located in boxes 57 identifies and groups localities with specific geographical regions and time zones. Y-shaped angle bracket members 47 close the inner ends of boxes 57. The inner linear ends of bracket members 47 align with scale indicia 52 and numerical indicia 51 to visually associate indicia 51 and 52 with the corresponding box 57 in the calculation of global advanced time.

A first modification of the indicator, designated generally at 130, is shown in FIGS. 6 to 11. Indicator 130 is a wall mounted global time indicating device having a generally flat rectangular shape. Indicator 130 has a front wall 131 assembled to back wall 132 with an assembly band 133. Front wall 131 is a mirror image of back wall 132 having its parts reversely arranged in comparison to back wall 132 being reversed relative to a vertical plane intervening between walls 131 and 132.

Figure 9:
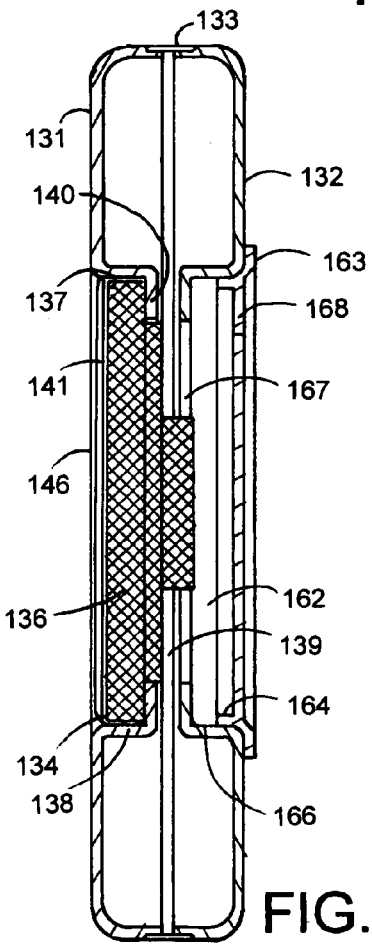
FIG. 9 is sectional view taken along line 9—9 of FIG. 6.
Figure 10:
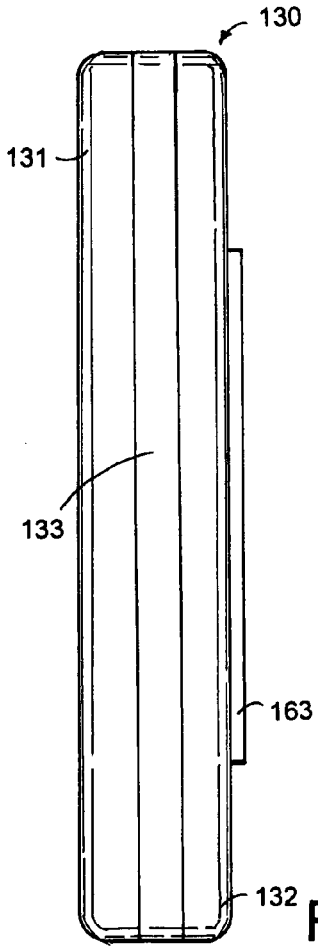
FIG. 10 is a side view of FIG. 6.

As seen in FIG. 9, front wall 131 is generally flat have an inwardly directed generally circular recess 134. Recess 134 is adapted to accommodate a generally circular clock member 136. Clock member 136 has an annular outer wall 137 located in tight fit frictional engagement with an inwardly directed transverse annular wall 138 surrounding the periphery of recess 134. An opening 139 in the bottom of recess 134 allows a rear portion of clock member 136 to extend there through into the adjacent recess 162 in back wall 132. An inwardly directed lip 140 located adjacent the back of clock member 136 holds clock member 136 in assembled relation with front wall 131.

Figure 6:
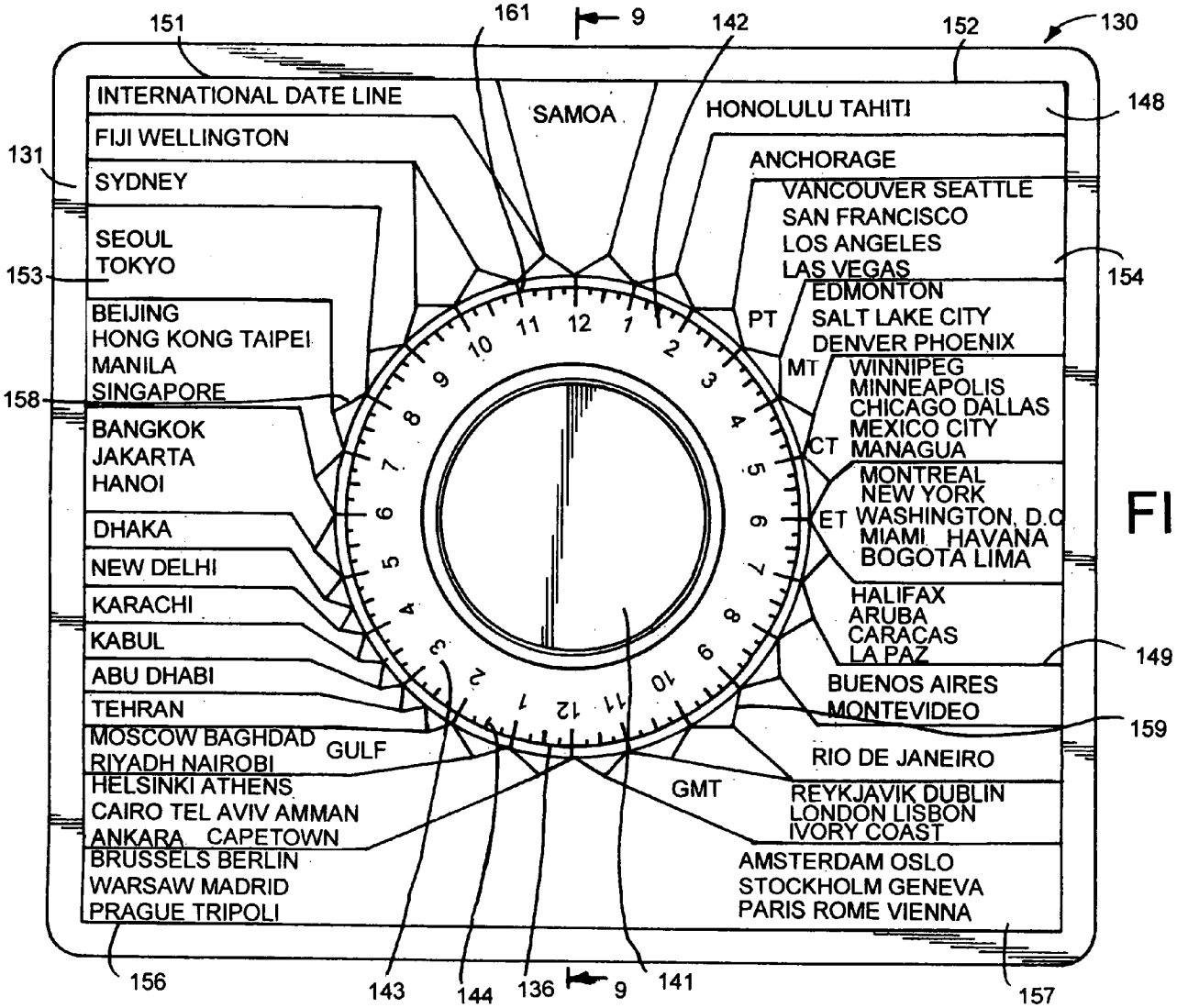
FIG. 6 is a front elevational view of a first modification of the global time indicator of FIG. 1.

Referring to FIG. 6, clock member 136 has a rotating generally circular disk or dial 141 having an outer annular ring 142. The outer surface of annular ring 142 has numerical indicia 143 and scale indicia 144 imprinted thereon indicating two 12-hour time periods divided into 15-minute increments. Preferably, clock member 136 is a battery operated device having a gear down ration of 2:1 whereby dial 141 is rotated counterclockwise one revolution during one 24-hour period. Annular ring 142 can have a shaded portion to differentiate afternoon and evening hours from morning hours. A transparent generally flat circular cover 146 attached to the front of clock member 136 shields dial 141.

Referring to FIG. 6, front wall 131 has an outer surface 148 having line indicia 149 forming vertical columns 151 and 152 having a plurality of generally rectangular shaped vertically disposed sections or boxes 153 and 154. Each box 153, 154 corresponds to a selected geographical region of the world and contains printed matter 156, 157 identifying the names of cities at which the same standard time is recognized. The city names 156, 157 are horizontally disposed and wholly contained with the confines of the box 153, 154 to minimize confusion. The city names 156, 157 do not overlap from one box to an adjacent box making it easy to determine at a glance the exact time of a given city in the world. The inner ends 158, 159 of boxes 153, 154 are located adjacent annular ring 142 of dial 141. Inner ends 158 and 159 are generally Y-shaped members that close the ends of boxes 153, 154 and have an apex 161 which extends adjacent time indicia 143, 144 to facilitate reference of the time indicia 143, 144 with a particular city.

Figure 7:
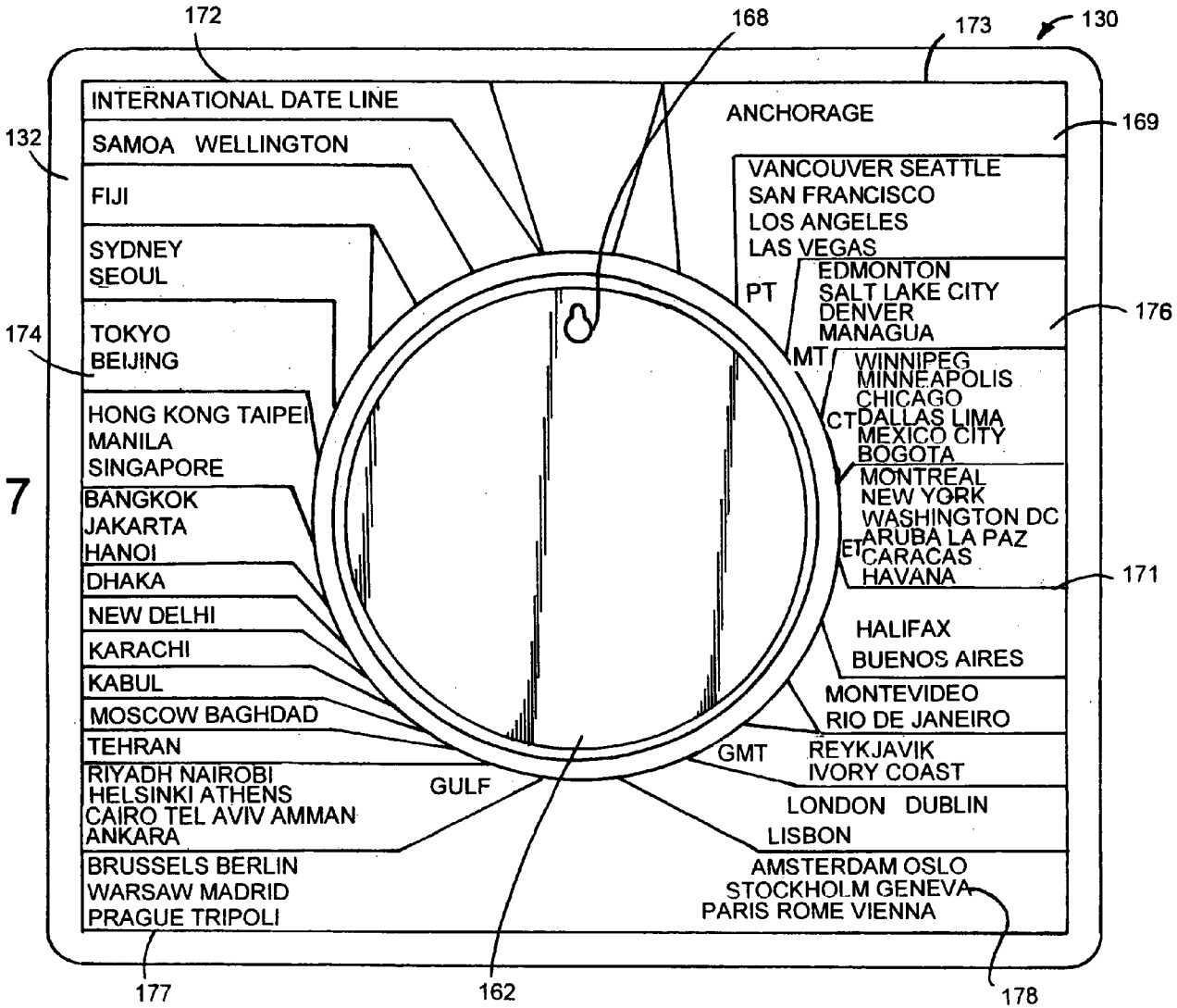
FIG. 7 is a rear plan view of FIG. 6.
Figure 8:
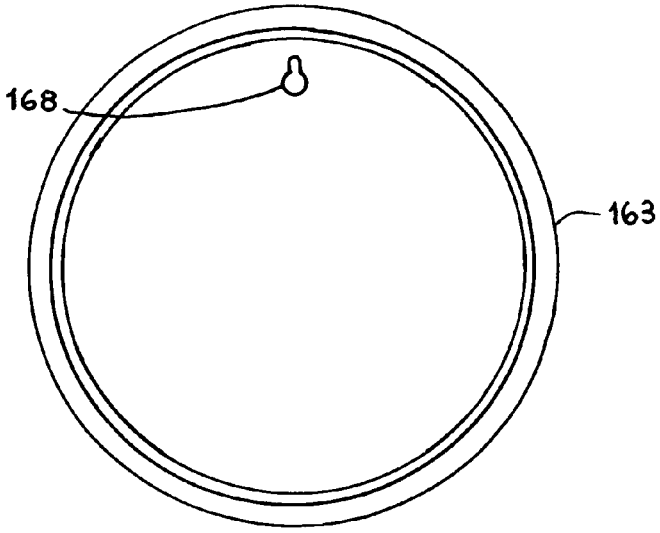
FIG. 8 is a front elevational view of the plug separated from the global time indicator of FIG. 6.

Back wall 132 has an inwardly directed generally circular recess 162 located opposite from and aligned with recess 134. As seen in FIG. 9, recess 162 is in open communication with recess 134. Recess 162 is adapted to accommodate a generally circular plug 163. Plug 163 has an annular outer lip 164 located in tight fit frictional engagement with inwardly directed transverse annular wall 166 of recess 162. The bottom of recess 162 has an opening 167 to allow access to the rear of clock member 136 for time adjustment and/or changing batteries. Plug 163 has a tear drop shaped opening 168 for accommodating a hanger member to mount indicator 130 on a vertical surface, such as a wall. Plug 163 can be removed from recess 162 to access clock member 136 for time adjustment and maintenance. Plug 163 and clock member 136 have substantially the same outer diameters whereby plug 163 and clock member 136 are interchangeable in recesses 134 and 162 to quickly modify indicator 130 during changes between standard time periods and advanced time periods, as seen in FIGS. 7 and 11.

Figure 11:
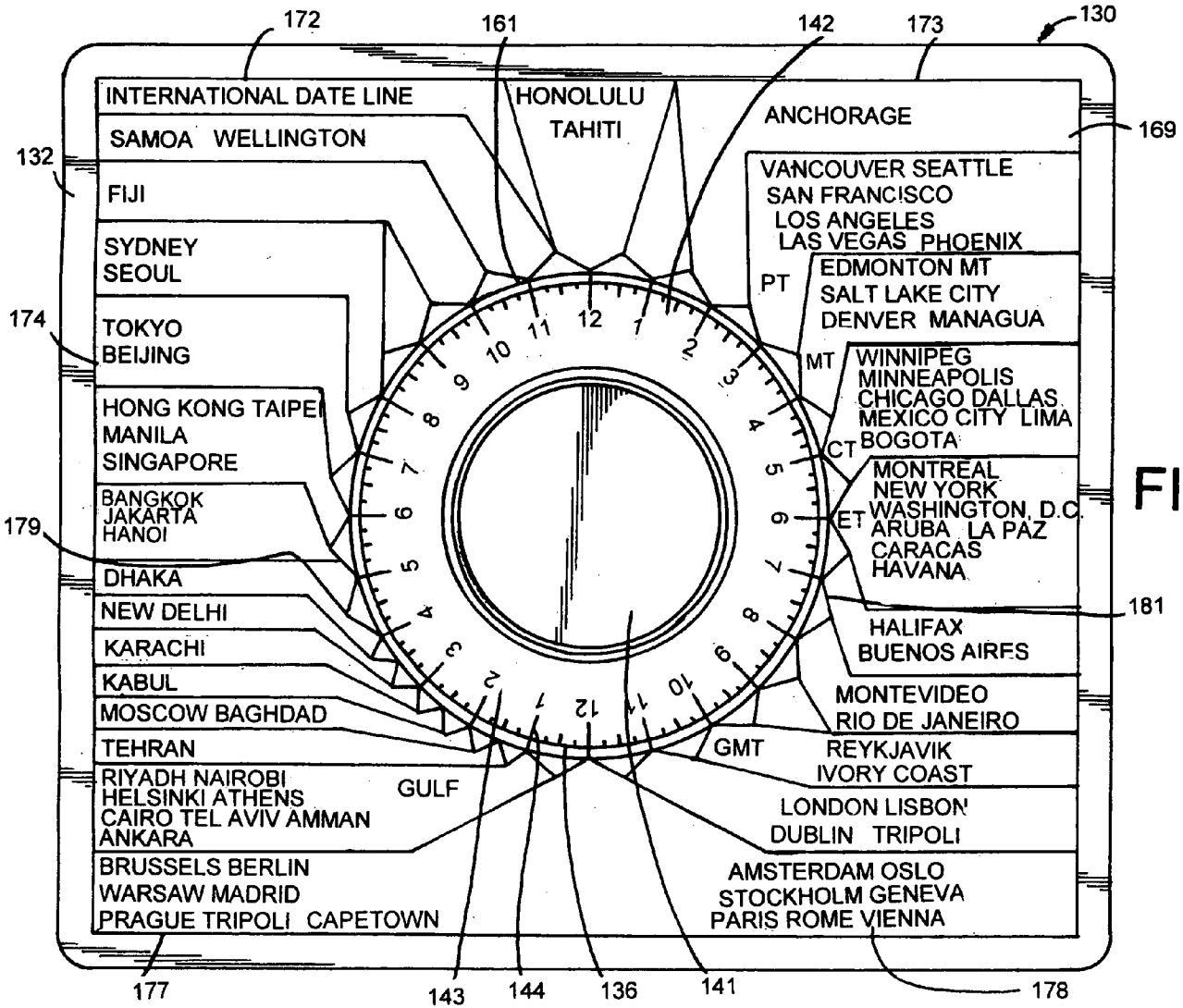
FIG. 11 is a rear elevational view of the global time indicator of FIG. 6 having the clock mechanism and plug reversed to indicate advanced time.

Referring to FIG. 11, back wall 132 has an outer surface 169 having line indicia 171 forming vertical columns 172 and 173 on opposite sides of back wall 132. Each column 172, 173 has a plurality of generally rectangular shaped vertically disposed boxes 174, 176 which correspond to a selected geographical region of the world. Each box 174, 176 contains printed names 177, 178 of cities and localities at which uniform time is observed during advanced time or daylight savings time periods. Boxes 174 and 176 have Y-shaped inner ends 179 and 181 located adjacent annular ring 142 of clock member dial 141 to facilitate the determination of present local time of a selected city.

Figure 14:
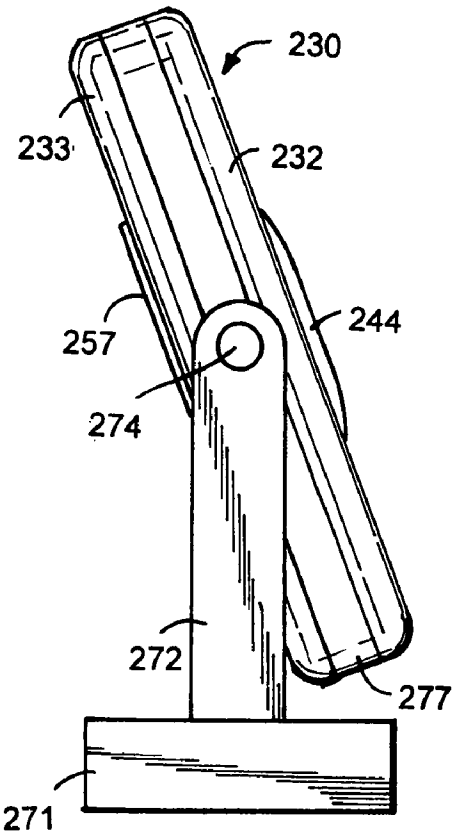
FIG. 14 is a left side view of FIG. 12 showing the body of the global time indicator in an inclined position.
Figure 13:
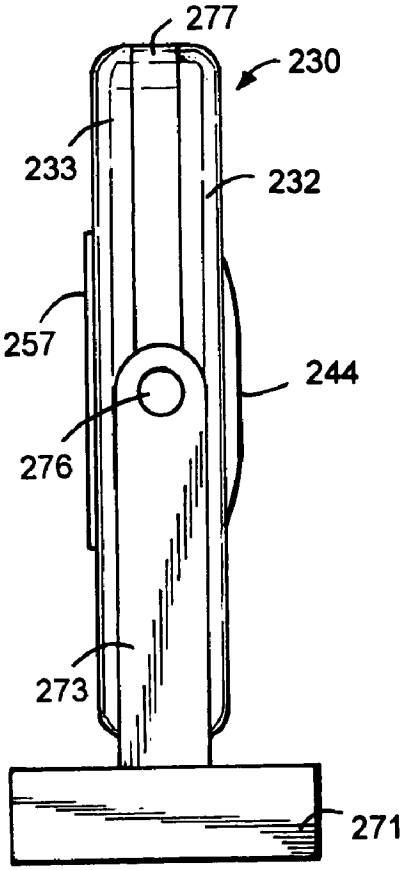
FIG. 13 is a right side view of FIG. 12.
Figure 15:
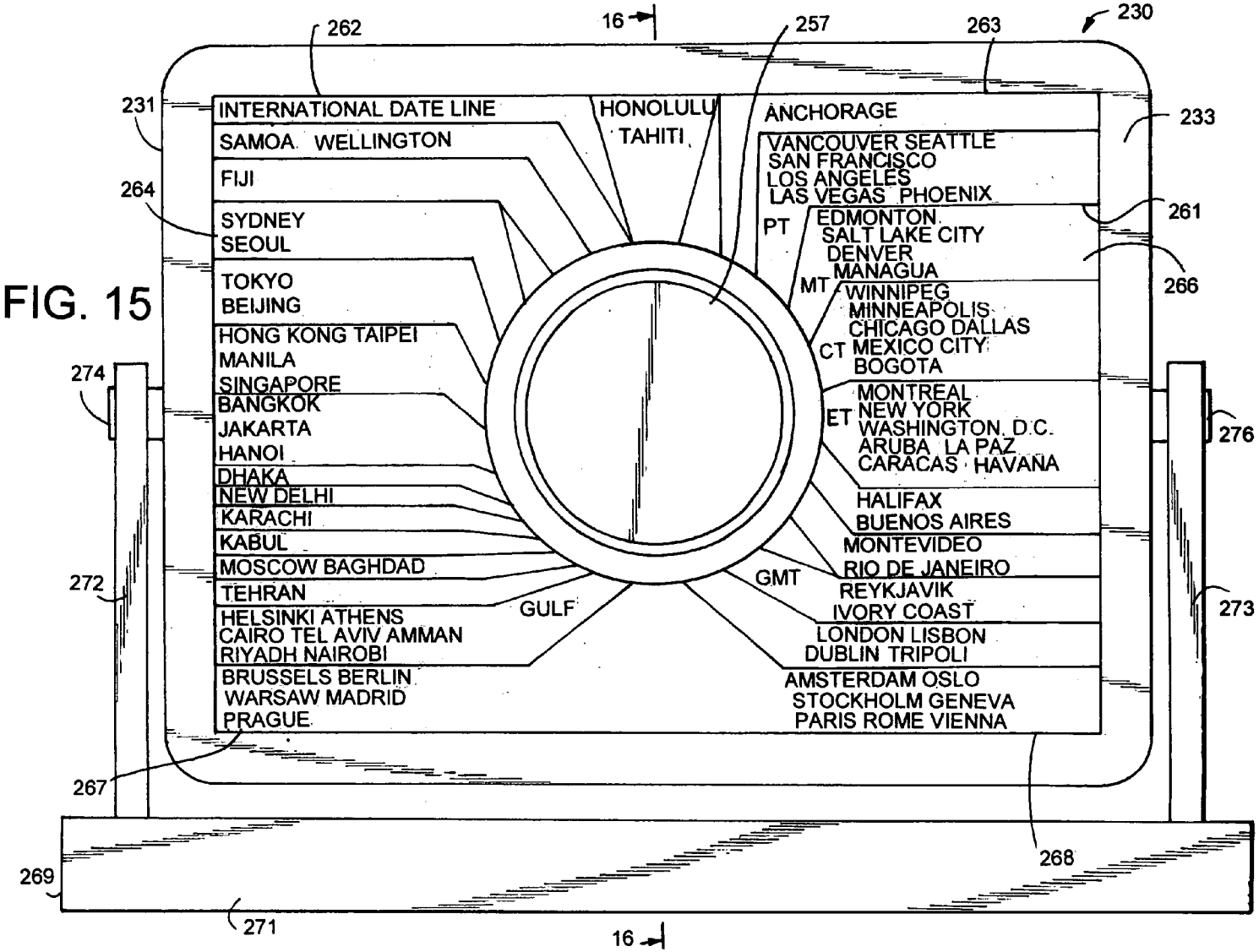
FIG. 15 is a rear plan view of FIG. 12.
Figure 16:
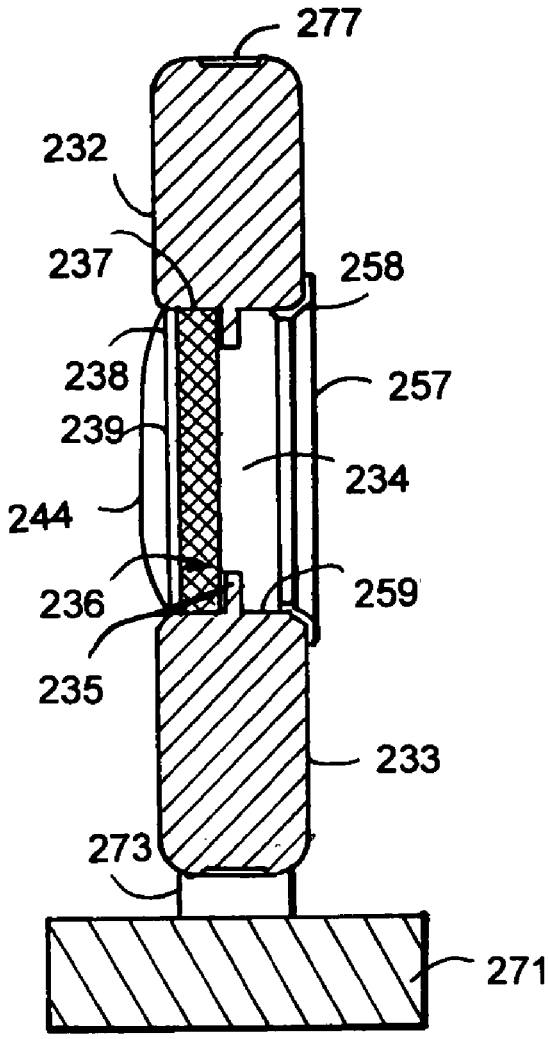
FIG. 16 is a sectional view taken along line 16—16 of FIG. 15.

A second modification of the indicator, referred to generally at 230, is shown in FIGS. 12 to 16. Indicator 230 is a desk top or table top supported time indicating device having a generally rectangular body 231 with generally flat front and back walls 232 and 233. As seen in FIG. 16, body 231 has a generally circular opening 234 extending through the middle portion of the body 231. A clock member 236 is accommodated by opening 234 adjacent front wall 232. Clock member 236 has an annular outer wall 237 located in tight fit frictional engagement with annular wall 238 surrounding the front of opening 234. The rear portion of clock member 236 engages an inwardly directed lip 235 extending into the middle of opening 234 to hold clock member 236 in assembled relation.

Clock member 236 has a rotating dial 239 having an outer annular ring 241 with numerical indicia 242 and scale indicia 243 imprinted on the outer surface thereof indicating two 12-hour time segments divided into 96 15-minute increments. Clock member 236 is preferably a battery operated time piece. Clock member 236 could also be an electric clock member. A transparent generally circular convex curved shield or cover 244 is attached to the front of clock member 236 forwardly from dial 239.

Figure 12:
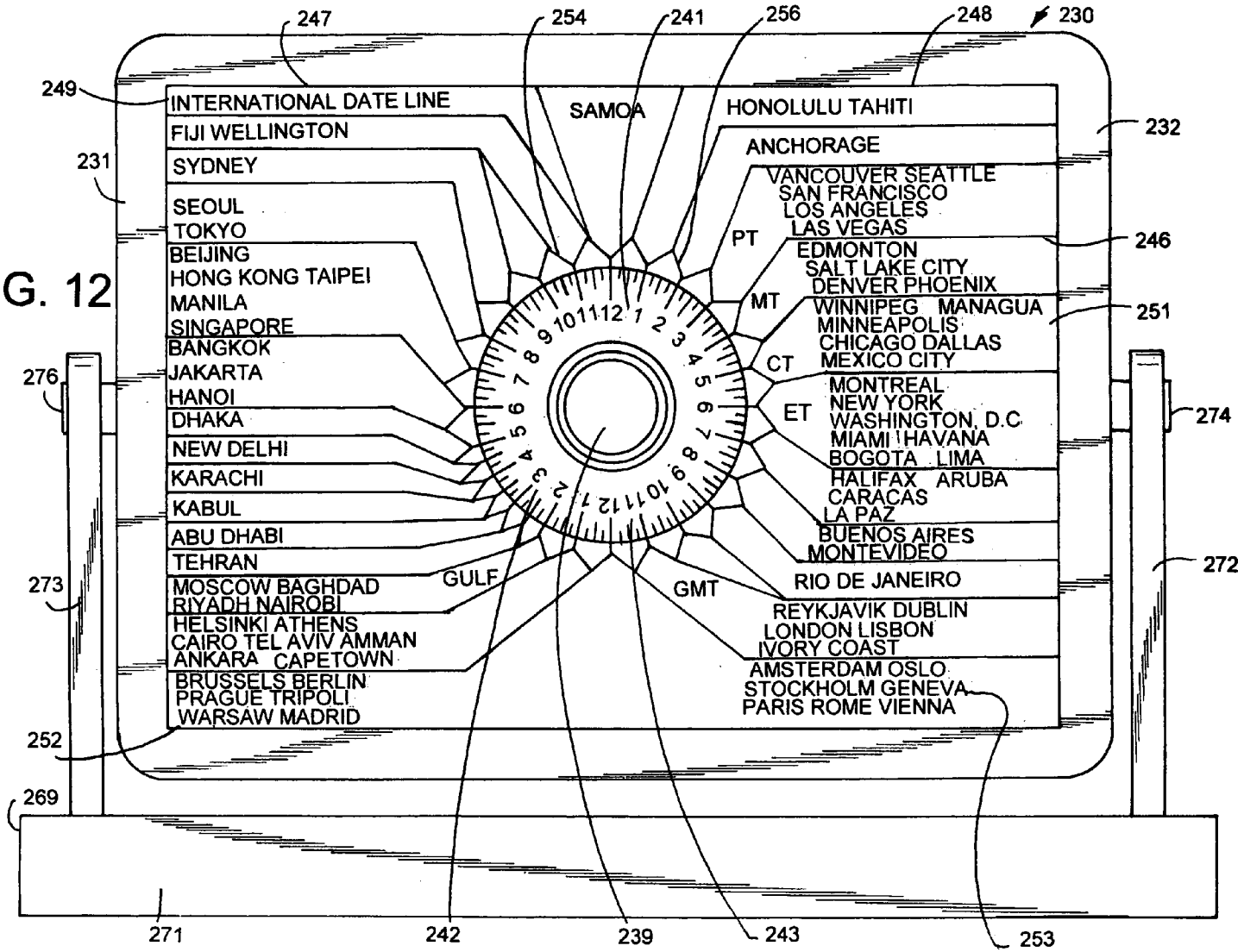
FIG. 12 is a front elevational view of a second modification of the global time indicator of FIG. 1.

Referring to FIG. 12, front wall 232 of body 231 has an outer surface having line indicia 246 forming oppositely disposed vertical columns 247 and 248. Each column 247, 248 has a plurality of vertically disposed boxes 249, 251 with inner closed ends 254, 256 corresponding to selected time zones throughout the world. Printed matter 252 and 253 contained within the boxes 249 and 251 identifies cities within each time zone having a common standard time whereby quick reference may be made to determine the time of day at a selected locale.

A generally circular plug 257 is accommodated by opening 234 adjacent back wall 233 and opposite from clock member 236. As seen in FIG. 16, plug 257 has an annular outer wall 258 located in a tight fit frictional engagement with an annular wall 259 surrounding the back of opening 234. Plug 257 can be removed from opening 234 to access clock member 236 for battery change time setting or adjusting. Plug 257 and clock member 236 are interchangeable in the front and back of opening 234 whereby indicator 230 may be quickly and easily changed to indicate global time during either standard time periods or advanced time periods.

Referring to FIG. 15, back wall 233 of body 231 has an outer surface having line indicia 261 forming oppositely disposed vertical columns 262 and 263. Each column 262, 263 has a plurality of vertically disposed boxes 264, 266 corresponding to selected time zones throughout the world. Printed matter 267 and 268 contained within the boxes 264 and 266 identifies cities within each time zone having a common advanced time whereby quick reference may be made to determine the time of day at a selected locale.

Indicator 230 has a stand member 269 to support indicator 230 on a horizontal surface such as a desk top, countertop and the like. Stand member 269 has a generally flat base 271 attached to upright members 272 and 273. Base 271 is preferably made from a relatively heavy material, such as marble or brass, to stabilize indicator 230. Pivot members 274 and 276 extend outward from opposite sides of a mounting strap 277 surrounding body 231 to rotatably connect body 231 to upright members 272 and 273. Pivot members 274 and 276 have a frictional fit with upright members 272 and 273 to allow body to be positioned in selected angular or inclined positions, as shown in FIG. 14, to facilitate viewing of clock member 236 from elevated positions.

There has been shown and described embodiments of the global time indicator of the invention. Changes in the materials, structures, markings, and arrangement of structures may be made by persons skilled in the art without departing from the invention.

The invention claimed is:

1. A manually operated global time indicating device for calculating international time comprising: a first wall joined to a second wall, a generally circular member rotatably mounted in sliding engagement with the first and second walls, the circular member having a centrally located outwardly projecting hub, the first wall and second wall each having an opening accommodating the hub, the hub having an outer annular surface bearing against an annular surface surrounding the opening to hold the circular member in assembled relation, the first wall and second wall each having line indicia forming first and second columns of vertically disposed boxes on opposite sides of the front wall, each box representing a geographical region within which a uniform time is recognized, printed matter contained within the box identifying localities within the geographical region, the circular member movable to move time indicia printed on the outer face of the hub adjacent the box whereby the time of day of other localities identified by the printed matter contained within another box can be determined.

2. The device of claim 1 wherein: the boxes on the first wall represent geographical regions within which a uniform time is used during a standard time period, the boxes on the second wall representing geographical regions within which a uniform time is used during an advanced time period.

3. The device of claim 1 wherein: the line indicia includes a plurality of vertically spaced linear segments extended perpendicular to the longitudinal axis of the circular member.

4. The device of claim 1 wherein: each box has a closed end located adjacent the time indicia to facilitate alignment of a desired time indicia with the box.

5. The device of claim 1 wherein: the front and back walls have aligned slot means for accommodating attachment means.

6. The device of claim 1 including: recesses in opposite top and bottom side edges of the front and back walls to expose outer peripheral top and bottom portions of the circular member.

7. A device to calculate local time in different geographical regions of the world comprising: a body having a front wall and a back wall, the front wall and back wall each having a centrally located recess adapted to accommodate a clock member, the clock member having a rotatable member located adjacent the front wall, the rotatable member having time indicia representing the time of day, the front wall and back wall each having line indicia forming first and second columns of vertically disposed boxes, each box representing a geographical region within which a uniform time is recognized, horizontally disposed printed matter located in the box identifying localities within the geographical region, the rotatable member movable to move time indicia for a selected time of day of a selected locality adjacent the box representing the geographical region of the selected locality whereby the time of day of one or more other localities designated by the printed matter located in another box can be determined.

8. The device of claim 7 wherein: the boxes on the front wall represent geographical regions within which a uniform time is used during a standard time period, the boxes on the back wall representing geographical regions within which a uniform time is used during an advanced time period.

9. The device of claim 7 including: a plug member located in the recess in the back wall, the clock member being located in the recess in the front wall.

10. The device of claim 9 wherein: the clock member and plug member are interchangeably located in the recess in the front wall and the recess in the back wall.

11. The device of claim 7 wherein: the clock member rotates the rotatable member one revolution during one 24-hour period of time.

12. The device of claim 7 wherein: the line indicia includes a plurality of vertically spaced linear segments extended perpendicular to the longitudinal axis of the rotatable member.

13. The device of claim 7 wherein: each box has a closed end located adjacent the time indicia to facilitate alignment of a desired time indicia with the box.

14. The device of claim 7 including: base means connected to the body to support the body on a horizontal surface.

* * * * *